US005095735A

United States Patent [19]

Schneider, Jr.

[11] Patent Number: 5,095,735

[45] Date of Patent: Mar. 17, 1992

[54] PITTSBURGH LOCK HAMMER GUIDE

[76] Inventor: Edward J. Schneider, Jr., 306 Myrtle, West Plains, Mo. 65775

[21] Appl. No.: 577,774

[22] Filed: Sep. 5, 1990

[51] Int. Cl.[5] ..... B21D 31/06

[52] U.S. Cl. ..... 72/479; 72/480; 72/379.2; 29/243.5

[58] Field of Search ..... 72/479, 480, 379.2; 29/243.5, 243.58; 173/112, 114, 173, 115

[56] References Cited

U.S. PATENT DOCUMENTS

| | | | |
|---|---|---|---|
| 2,233,937 | 3/1941 | Hexdall | 29/243.5 |
| 2,353,559 | 7/1944 | Hajek, Jr. | 72/479 |
| 2,637,292 | 5/1953 | George, Jr. | 72/479 |
| 3,188,729 | 6/1965 | Pogue, Jr. et al. | 29/243.58 |
| 3,426,573 | 2/1969 | Wilson, Jr. | 72/479 |
| 4,649,733 | 3/1987 | Gilmore | 29/275 |

FOREIGN PATENT DOCUMENTS

| | | | |
|---|---|---|---|
| 1005467 | 4/1957 | Fed. Rep. of Germany | 173/171 |

*Primary Examiner*—David Jones

[57] ABSTRACT

A guide for removable attachment to a conventional pneumatic hammer adapts the hammer for use as a Pittsburgh lock hammer. The guide includes a hollow, open-ended tubular element which defines a fragmentary cylindrical wall, and an adjustable fastener is attached to the exterior surface of the wall for removably attaching the element to the pneumatic hammer.

3 Claims, 2 Drawing Sheets

PITTSBURGH LOCK HAMMER GUIDE

This invention relates to a sheet metal working tool and more particularly to a guide for removable attachment to a conventional pneumatic hammer for adapting the hammer for use as a Pittsburgh lock hammer.

Various types of tools are known for use in creating Pittsburgh locks in sheet metal duct work. A Pittsburgh lock is a corner joint in sheet metal duct work, and the joint is closed and locked together by hammering a lip of sheet metal through a ninety degree arc along the length of a section of the duct work. When a mushroomed shaped tool, called a body smoothing hammer, is installed in a common pneumatic hammer, the combination is capable of hammering down a Pittsburgh lock. However, it is difficult to control such a tool.

It is, therefore, an object of the present invention to provide a guide for removable attachment to a conventional pneumatic hammer for adapting the hammer for use as a Pittsburgh lock hammer.

Another object is to provide such a guide which can be adjustably attached to a conventional pneumatic hammer.

A further object of the invention is the provision of such a guide which extends past the head of the pneumatic hammer's striking element for engaging the side of the sheet metal duct work while the head of the striking element rides against the Pittsburgh lip at the corner of the duct.

Still another object is to provide such a guide which is easy and inexpensive to manufacture.

Yet another object of the present invention is the provision of such a guide which can be quickly and easily removably attached to a conventional pneumatic hammer to form a Pittsburgh lock hammer.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides a guide for removable attachment to a conventional pneumatic hammer for adapting the hammer for use as a Pittsburgh lock hammer. The guide includes a hollow, open-ended, tubular element defining a fragmentary, substantially cylindrical wall, and adjustable means are provided in operative relationship with the wall for removably attaching the element to the pneumatic hammer.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

Figure 1:
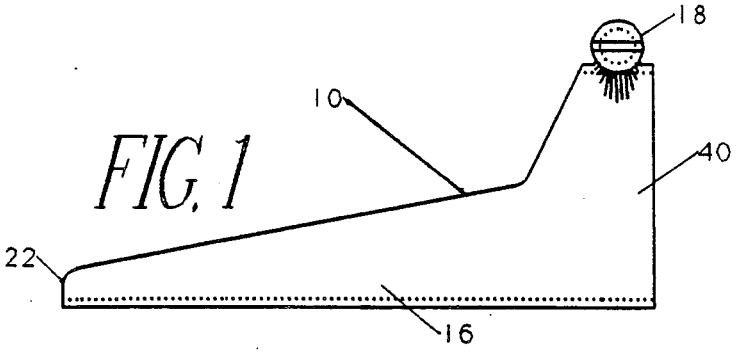
FIG. 1 is a side elevation view of the guide.

With reference now to the drawings, wherein like reference characters designate like or corresponding parts throughout the several views, there is shown a guide 10, in accordance with this invention, for removable attachment to a conventional pneumatic hammer 12 for adapting the hammer for use as a Pittsburgh lock hammer. Guide 10 comprises a hollow, open ended, tubular element defining a fragmentary, substantially cylindrical wall.

Figure 8:
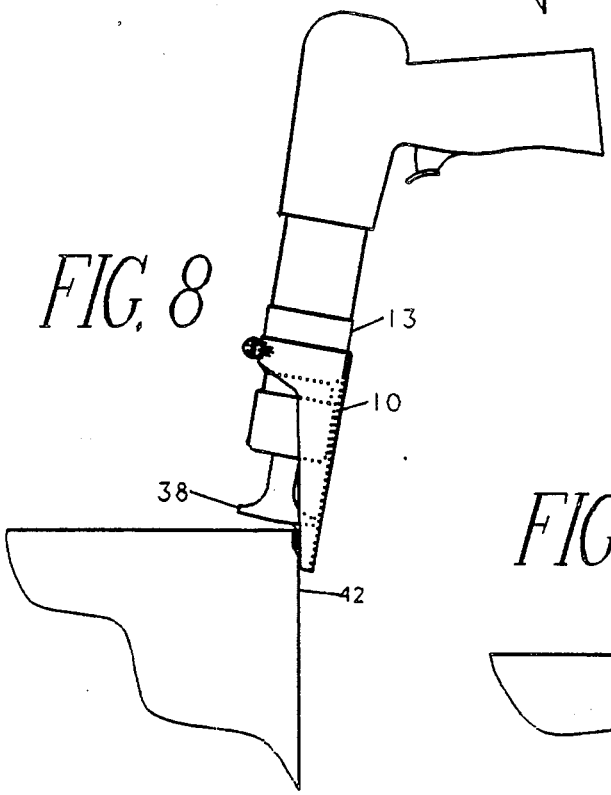
FIG. 8 illustrates the hammer and guide in an intermediate position for completing formation of the Pittsburgh lock.
Figure 9:
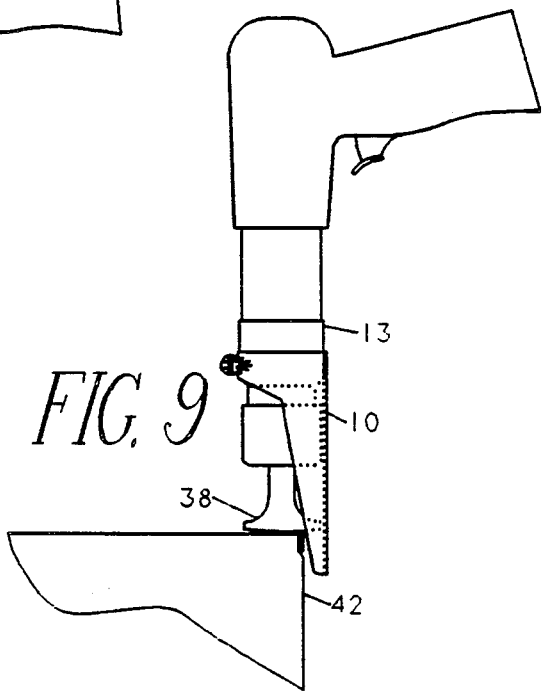
FIG. 9 shows the hammer and guide in the final position for completing formation of the Pittsburgh lock.

Guide 10 consists of 4 basic elements:

1. The guide lip 22, which projects forward and below the striking element 38. The guide lip 22, rides against the side of the ductwork 42, FIGS. 7 through 9, it's position in relation to the striking element and rotational position in relation to the handle of the pneumatic hammer is critical to the effectiveness of the combined tool.

2. An internally cylindrical clamping surface provided by the inside of the area 40, of the guide. This allows the guide 10, to be clamped securely to the hammer retainer 13.

3. The area of guide 10, between the guide lip 22, and the clamping surface 40, which provides a solid intermediary portion precluding movement between guide lip 22 and clamping surface 40, is labeled 16 in the drawings. Extending the cylindrical clamping surface 40, toward the guide lip 22, cutting away the area diametrically opposite the guide lip 22, to allow access to the retainer 13, and striking element 38, forms solid intermediary portion 16, and the further acute angle extension forms guide lip 22, which results in the basic shape shown.

4. A means of controlling the clamping pressure of area 40 to the retainer 13, is provided by item 18, as detailed by items 32, 34, and 36. This allows the clamping pressure to be eliminated, allowing removal or rotational adjustment of the guide 10.

Guide 10 is preferably made of a mild, low carbon steel. In fabricating guide 10, flat stock is roll-formed into its final tubular shape on conventional tube forming equipment (not shown). The final shape of guide 10 is then cut from the formed stock in a conventional process. For example, use of a plasma arc cutter makes it easy to cut the final shape of guide 10 from the tubularly shaped stock. If larger production volumes are required, wall 16 in its flattened, planar configuration, shown in FIG. 3, can be blanked to the shape shown and then the blank is formed into tubularly-shaped element 14 using a more complicated, but conventional, punch and die process.

Figure 3:
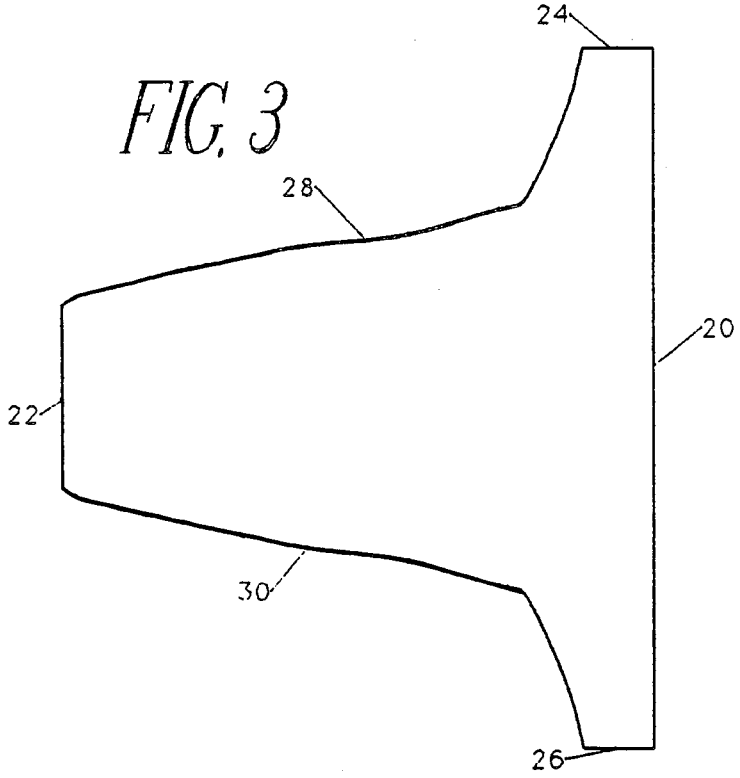
FIG. 3 is a plan view of a blank from which the guide can be formed and showing the blank flattened in a substantially planar configuration.

In accordance with the invention, wall 16 defines a substantially triangular shape, as best illustrated in FIG. 3, if wall 16 is opened out from its normally tubular configuration and flattened to a substantially planar configuration.

The planar configuration of wall 16, as illustrated in FIG. 3, defines first and second opposed and substantially straight, parallel edges 20, 22. Third and fourth opposed and substantially straight, parallel edges 24, 26 extend from edge 20. A fifth curved and concave edge 28 extends between edges 22 and 24, and a sixth curved and concave edge 30 opposed to concave edge 28, extends between edges 22 and 26.

Figure 2:
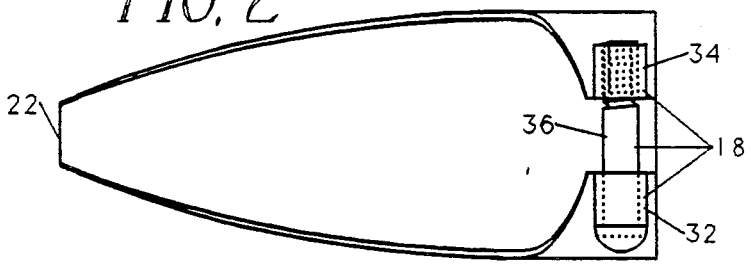
FIG. 2 is a top plan view of the guide.
Figure 4:
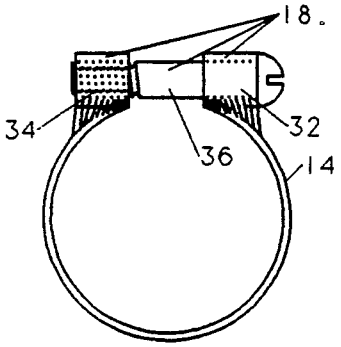
FIG. 4 is an end elevation view of the guide and looking from the left side of FIG. 1.
Figure 5:
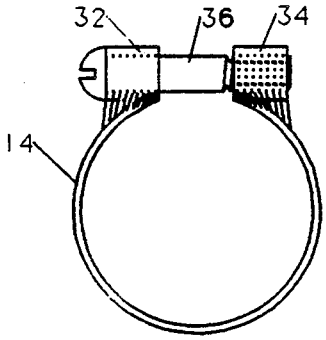
FIG. 5 is an end elevation view of the guide and looking from the right side of FIG. 1.
Figure 6:
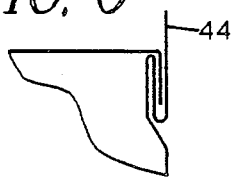
FIG. 6 shows a conventional Pittsburgh lock for use in sheet metal duct work.

When wall 16 is formed into tubular element 14, edges 24 and 26 are positioned in opposed relationship and adjacent to each other and in substantially abutting relationship with each other, as best illustrated in FIGS. 2, 4 and 5. Adjustable attaching means 18 are preferably fastened to wall 16 adjacent to edges 24 and 26.

In accordance with the invention, adjustable attaching means 18 preferably include a first threaded bolt-receiving element 32 attached to an exterior surface of wall 16 of tubular element 14 and adjacent to edge 24. A second bolt-receiving element 34 is preferably attached to the exterior surface of wall 16 and adjacent to edge 26. A threaded bolt 36 extends through bolt-receiving elements 32, 34 and threadably engages at least element 32 so that guide 10 can be adjustably and removably attached to the housing of pneumatic hammer 12.

Figure 7:
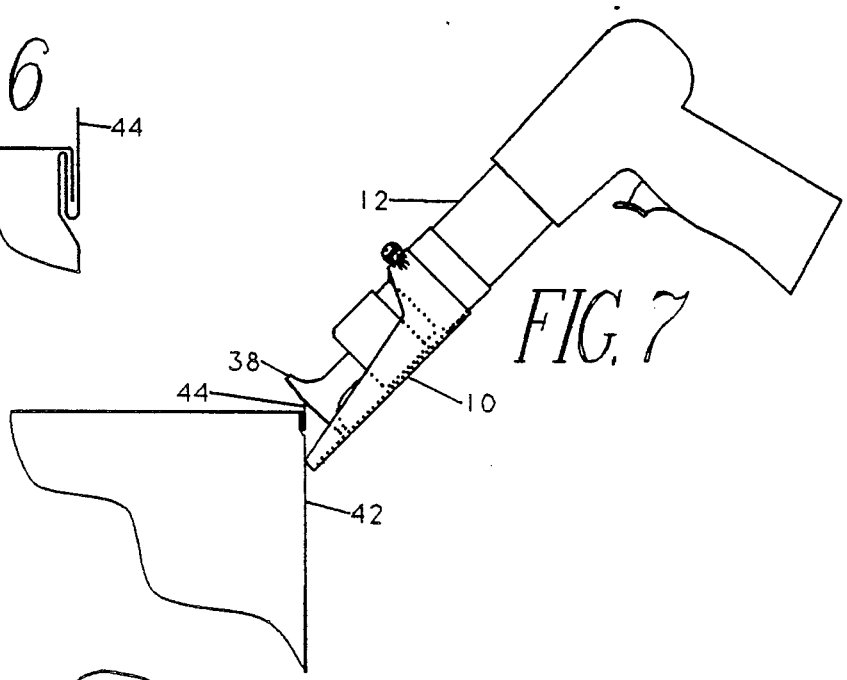
FIG. 7 shows a conventional pneumatic hammer having the guide attached and with the hammer and guide in a starting position for completing formation of the Pittsburgh lock.

In use, striking element 38 is conventionally attached to pneumatic hammer 12. Guide 10 is then removably and adjustably attached to the retainer 13, of hammer 12 by positioning the clamping surface 40 of guide 10 around the retainer 13, of hammer 12. Threaded bolt 36 is then turned to draw together receiving elements 32, 34 and to firmly attach the clamping surface 40 of guide 10 to the retainer 13, of pneumatic hammer 12. The projection of guide lip 22, of guide 10 past the head portion of striking element 38 is placed against side 42 of the duct work while the striking element 38 rides against Pittsburgh lip 44 at the corner of the duct. This position is illustrated in FIG. 7. Guide 10, positioned against side 42, together with the pistol grip configuration of conventional pneumatic hammer 12, provides the operator with good control.

As shown in FIG. 7, the operator energizes hammer 12 and moves it along the entire length of the Pittsburgh seam. The result will be to hammer Pittsburgh lip 44 over and through an angle of approximately forty-five degrees, due to the action of the convex surface of striking element 38. The operator then rotates hammer 12 to the position shown in FIG. 8, energizes hammer 12, and moves it along the entire length of the Pittsburgh lock seam lip 44. This pass hammers lip 44 over to an angle of approximately eighty degrees from its original position. The operator then rotates hammer 12 to the position in FIG. 9, energizes the hammer, and moves it along the entire length of lip 44 to complete the seam. More or less passes along the seam may be used depending on metal type and the appearance desired.

The invention in its broader aspects is not limited to the specific details shown and described and departures may be made from such details without departing from the principles of the invention and without sacrificing its chief advantages.

What is claimed is:

1. A guide for removable attachment to a conventional pneumatic hammer having a retainer, said retainer retaining a convex head striking element therein, said guide adapting the hammer, retainer, and striking element for use as a Pittsburgh lock hammer in creating Pittsburg locks in sheet metal duct work, said guide comprising:

a guide lip means projecting past and below the striking element when attached to said hammer;

an internally cylindrical clamping surface connected to said guide for attaching said guide to said hammer retainer;

adjustable means in operative relationship with said clamping surface for removably clamping and rotationally adjusting said guide to said hammer retainer; and a solid intermediary portion connected between the cylindrical clamping surface and the guide lip means for precluding motion between said clamping surface and said guide lip means, wherein said guide when attached to said pneumatic hammer, guides said striking element in forming Pittsburg locks.

2. A tool for closing and creating Pittsburgh locks in sheet metal, said tool comprising:

a pneumatic hammer;

a striking element retainer a convex head striking element installed in said retainer;

a guide removably attached to said retainer for adapting the hammer, retainer, and striking element for use as a Pittsburgh lock hammer in creating said Pittsburgh locks, said guide comprising:

a guide lip means projecting past and below the striking element;

an internally cylindrical clamping surface connected to said guide for attaching the guide to hammer retainer;

adjustable means in operative relationship with said clamping surface for removably clamping and rotationally adjusting said guide to said pneumatic hammer retainer; and a solid intermediary portion connected between the cylindrical clamping surface and the guide lip means for precluding motion between said clamping surface and said guide lip means, wherein said guide attached to said pneumatic hammer, guides said striking element in forming Pittsburg locks.

3. A guide as in claim 1 wherein said solid intermediary portion between the internally cylindrical clamping surface and the guide lip means, is formed cylindrical extension of the cylindrical clamping surface which narrows downwardly toward said guide lip means.

* * * * *